US005729974A

United States Patent [19]

Takashima

[11] Patent Number: 5,729,974

[45] Date of Patent: Mar. 24, 1998

[54] EXHAUST SYSTEM FOR A "V"-TYPE ENGINE

[75] Inventor: Suguru Takashima, Iwata, Japan

[73] Assignee: Yamaha Hatsudoki Kabushiki Kaisha, Shizuoka-ken, Japan

[21] Appl. No.: 720,701

[22] Filed: Oct. 2, 1996

[51] Int. Cl.[6] ..... F02B 27/02

[52] U.S. Cl. ..... 60/313

[58] Field of Search ..... 60/313, 323, 312; 180/219

[56] References Cited

U.S. PATENT DOCUMENTS

| | | | |
|---|---|---|---|
| Re. 31,724 | 11/1984 | Isaka | 60/313 |
| 3,453,824 | 7/1969 | Biesecker | 60/313 |
| 4,522,282 | 6/1985 | Yamamoto | 60/323 |
| 4,763,052 | 8/1988 | Shinozake et al. | 60/313 |
| 4,831,823 | 5/1989 | Ueda | 60/313 |
| 4,903,483 | 2/1990 | Atsuumi et al. | 60/313 |
| 4,939,898 | 7/1990 | Ichimura et al. | 60/313 |

*Primary Examiner*—Marguerite McMahon
*Attorney, Agent, or Firm*—Knobbe, Martens, Olson & Bear, LLP

[57] ABSTRACT

An exhaust system for a "V"-type engine having front and rear banks of cylinders each containing two cylinders is disclosed. The exhaust system includes a pair of cylinder heads and exhaust pipes connected thereto. Each cylinder head has two exhaust ports corresponding to the two cylinders of that bank. The exhaust ports in the front cylinder head face forwardly and lie in planes which intersect one another along a line offset to the right of a centerline of the cylinder head. Similarly, the exhaust ports in the rear cylinder head face rearwardly and lie in planes which intersect one another along a line offset to the left of a centerline of the head. Each offset is preferably equal to half of the distance between planes containing the front and rear camshaft timing chains. An exhaust pipe extends outwardly from each exhaust port in the front cylinder head, bending inwardly and downwardly and extending to the rear of the motorcycle. An exhaust pipe extends from each exhaust port in the rear cylinder head, these pipes directed to the rear of the motorcycle beyond the front exhaust pipes.

27 Claims, 7 Drawing Sheets

EXHAUST SYSTEM FOR A "V"-TYPE ENGINE

FIELD OF THE INVENTION

The present invention relates to an exhaust system for a "V"-type engine, the exhaust system including a cylinder head having a pair of exhaust ports for communication with a pair of exhaust pipes.

BACKGROUND OF THE INVENTION

"V"-type engines typically have a front bank of cylinders, and a rear bank of cylinders. The front and rear banks of cylinders are inclined with respect to one another. Each cylinder has a head with at least one exhaust port. An exhaust pipe is connected to each exhaust port for routing exhaust gases away from the engine. When the engine is utilized to propel a motorcycle or similar vehicle, the exhaust pipe leads from the engine to a point near the rear of the vehicle, distal of the driver and riders.

It is desirable for the exhaust pipes to extend in compact fashion along the sides of the motorcycle. If the exhaust pipes lie outwardly of the sides of the motorcycle too far, they increase the overall width of the motorcycle and are positioned where the driver or a rider may come into contact with them. Further, the exhaust pipes must be routed from the exhaust ports of the cylinder heads of the engine to the rear of the motorcycle around other features of the motorcycle, such as the frame and radiator. In an attempt to meet these design criteria, exhaust pipes normally include several bends to accommodate their extension to the rear of the motorcycle. Further, each cylinder head is often unique in design so as to orient the exhaust port in a position which allows the exhaust pipe to be easily connected thereto.

Both of these attempted solutions to the problem of exhaust pipe orientation themselves have drawbacks. First, numerous and/or sharp bends in the exhaust pipe restrict exhaust flow and create back pressure which lowers the efficiency of the engine. Second, having each cylinder head custom designed with a unique exhaust port location increases the cost of producing the engine as each head must be independently design and manufactured.

It is desirable to provide an engine with an exhaust system which includes a simple cylinder head construction and exhaust pipes which extend in compact fashion along the sides of the motorcycle with minimal flow restrictions.

SUMMARY OF THE INVENTION

In accordance with the present invention there is provided an exhaust system for a "V"-type engine. The exhaust system includes at least one cylinder head containing two exhaust ports, and an exhaust pipe corresponding to each exhaust port.

The engine includes a front bank and a rear bank each having at least one cylinder. A cylinder head is provided for each bank. The cylinder head includes a first and a second exhaust port for exhausting gases from that bank.

The first and second exhaust ports extend outwardly of the cylinder head to an end. The cylinder head has a centerline extending between the first and second exhaust ports.

The ends of the first and second exhaust ports lie in planes which are generally perpendicular to one another. The intersection of these planes is a line which is offset from the centerline of the cylinder head.

Preferably, the engine is mounted on a motorcycle including a front wheel and rear wheel connected to a frame. The exhaust ports corresponding to the head of the front bank preferably face forwardly, while the exhaust ports corresponding to the head of the rear bank preferably face rearwardly.

An exhaust pipe is connected to each of the exhaust ports of the front cylinder head. The exhaust pipes extend outwardly from the front cylinder head, then curve downwardly and inwardly before extending generally horizontally to the rear of the motorcycle. These exhaust pipes extend on opposite sides of the motorcycle from one another.

An exhaust pipe is also connected to each of the exhaust ports of the rear cylinder head. These exhaust pipes extend rearwardly from the engine to a point slightly beyond the terminal ends of the exhaust pipes corresponding to the front bank of cylinders.

The exhaust ports are arranged in the cylinder heads in a manner which permits the exhaust pipes leading therefrom to have minimal bending curvature and yet avoid other elements of the motorcycle and be oriented in compact fashion along the sides of the motorcycle.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
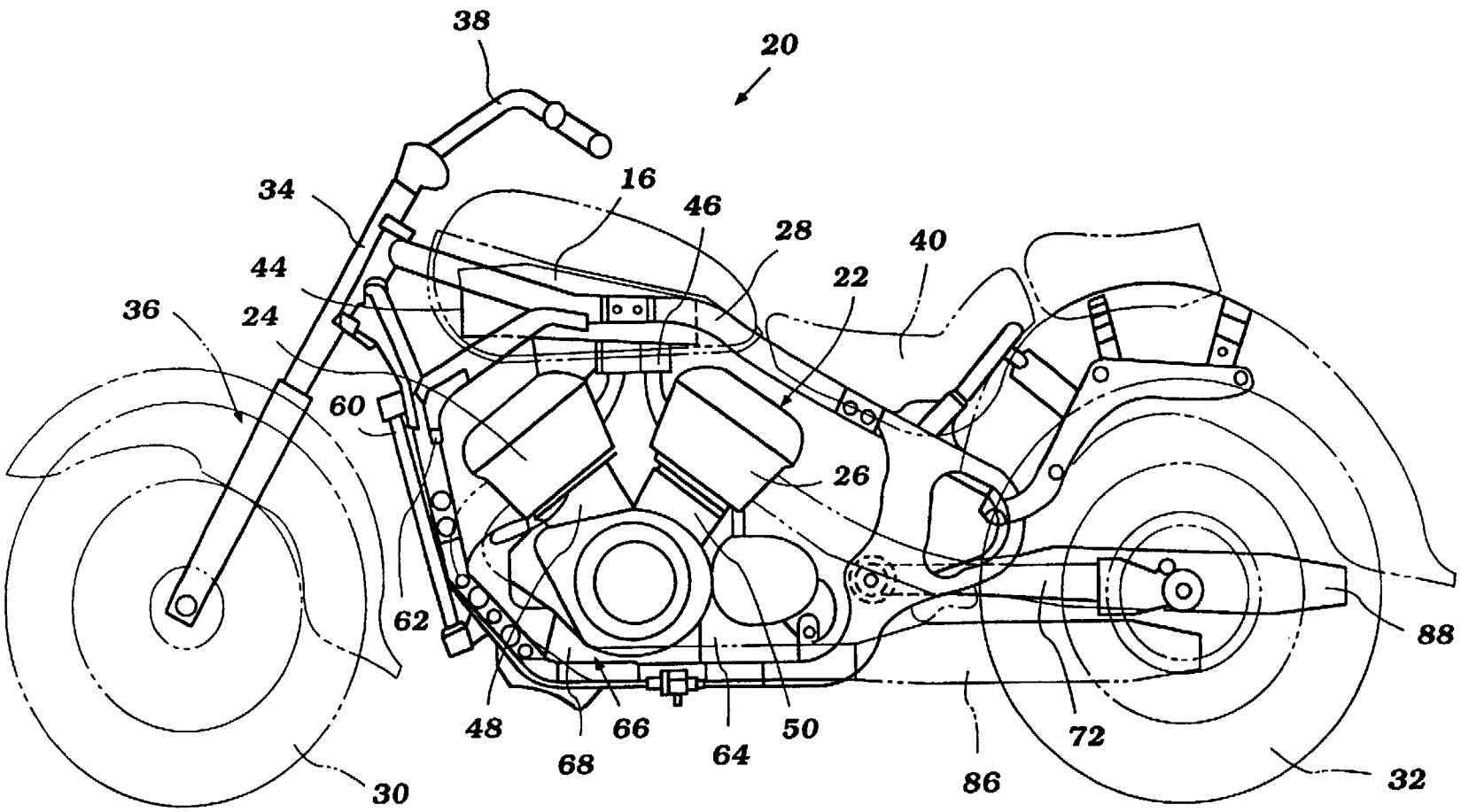
FIG. 1 is a side view of a motorcycle having a "V" engine with front and rear banks of cylinders, each bank having a cylinder head of the present invention and a pair of exhaust pipes connected thereto.
Figure 2:
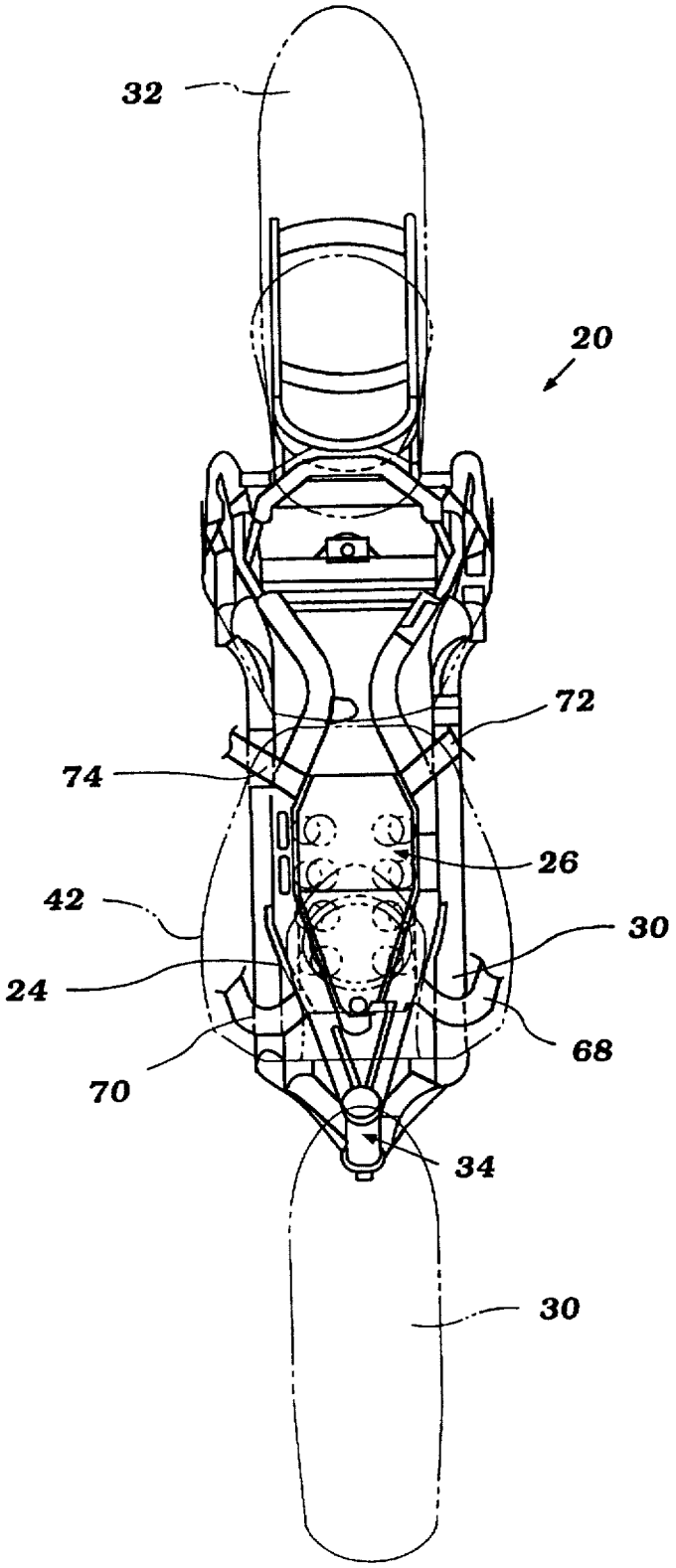
FIG. 2 is a top view of the motorcycle of FIG. 1.

FIGS. 1 and 2 illustrate a motorcycle 20 having an engine 22 having an exhaust system in accordance with the present invention. In general, the exhaust system includes front and rear cylinder heads 24, 26 and four exhaust pipes 68, 70, 72, 74.

The motorcycle 20 is of the type well known in the art, and therefore will not be described in detail herein. In general, the motorcycle 20 includes the engine 22, as well as a frame 28, front wheel 30, rear wheel 32, and a steering mechanism 34 for the front wheel 30.

The front wheel 30 is connected to the frame 28 via a front fork 36. A pair of handlebars 38 are connected to the front fork 36. The handlebars 38 and front fork 36 are rotatably connected to the frame 28, allowing a rider to turn the front wheel 30.

The rear wheel 32 is also connected to the frame 28. The rear wheel 32 is driven by the engine 22 via a coupling from the output shaft of the engine 22.

A seat 40 is mounted to the frame 28 on which a rider may sit during operation of the motorcycle 20.

A fuel system provides fuel to the engine 22. The fuel system includes a fuel tank 42 mounted to the frame 28 of the motorcycle 20. Appropriate fuel lines and a fuel pump (not illustrated) are provided for moving the fuel from the tank 42 to the engine 22.

Similarly, an air inlet 44 provides air to the engine 22 for combustion of the fuel. The air inlet 44 is in communication with the atmosphere, and routes air into an airbox 46. Air passages lead from the airbox 46 to the combustion chamber of each cylinder of the engine 22.

A cooling system is provided for cooling the engine 22. Preferably, the cooling system includes a radiator 60. The radiator 60 is mounted to a front frame section 62 of the frame 28 of the motorcycle 20, just behind the front wheel 30. The face of the radiator 60 extends generally perpendicular to the length of the motorcycle 20 so that maximum area of the radiator is exposed to air flow. The cooling system preferably also includes appropriate hoses for routing coolant from the radiator 60 to the engine 22, and from the engine back to the radiator.

Preferably, the present invention is utilized with an engine 22 of the "V"-type, having a front bank 48 containing at least one cylinder and a rear bank 50 containing at least one cylinder. Preferably, the front bank 48 of cylinders contains a first and a second cylinder 52, 54, and the rear bank 50 of cylinders contains a third and a fourth cylinder 56, 58.

The front and rear banks of cylinders 48, 50 are inclined with respect to one another. In particular, the front bank of cylinders 48 preferably tilts forwardly towards a front of the motorcycle 20. The rear bank of cylinders 50 tilts rearwardly towards a rear of the motorcycle 22.

The front and rear banks of cylinders 48, 50 each extend from a block 64. A lower section of the block 64 defines a crankcase 66 in which rotates a crankshaft (not illustrated). Each cylinder 52, 54, 56, 58 contains a piston (not illustrated) which is connected to the crankshaft via a connecting rod. Movement of the pistons effectuates rotation of the crankshaft, which in turn powers the rear wheel 32 of the motorcycle 20.

Each cylinder 52, 54, 56, 58 has a pair of exhaust and intake valves which are opened and closed with a camshaft (not illustrated) as is well known in the art. The camshafts corresponding to the front and rear cylinder banks 48, 50 are each driven by a timing chain connected to the crankshaft. A front camshaft timing chain corresponding to the front cylinder bank 48 extends from the crankshaft in a vertical plane which extends generally perpendicular to the crankshaft (i.e. parallel to a line extending from the front to the rear of the motorcycle).

The rear camshaft timing chain corresponding to the rear cylinder bank 50 extends in a second vertical plane. The second plane is also generally perpendicular to the crankshaft, and thus parallel to the plane in which the front crankshaft timing chain extends. The timing chains are separated by an offset distance, such that the first and second timing chain planes are offset by the same distance.

The first and second cylinders 52, 54 have their centerlines equidistant from the plane in which the front camshaft timing chain extends. Similarly, the third and fourth cylinders 56, 58 have their centerlines equidistant from the plane in which the rear camshaft timing chain extends.

A top portion of each cylinder 52, 54, 56, 58 is defined by a cylinder head. Preferably, a common first or front cylinder head 24 is utilized for the first and second cylinders 52, 54 of the front bank of cylinders 48. Likewise, a second or rear cylinder head 26 is utilized for the third and fourth cylinders 56, 58 of the rear bank of cylinders 50.

Exhaust is muted from each cylinder 52, 54, 56, 58 by a respective exhaust pipe. Preferably, a first exhaust pipe 68 and a second exhaust pipe 70 are connected to the front cylinder head 24 for routing exhaust gases from the first and second cylinders 52, 54, respectively. A third exhaust pipe 72 and fourth exhaust pipe 74 are connected to the rear cylinder head 26 for routing exhaust from the third and fourth cylinders 56, 58, respectively.

Figure 4:
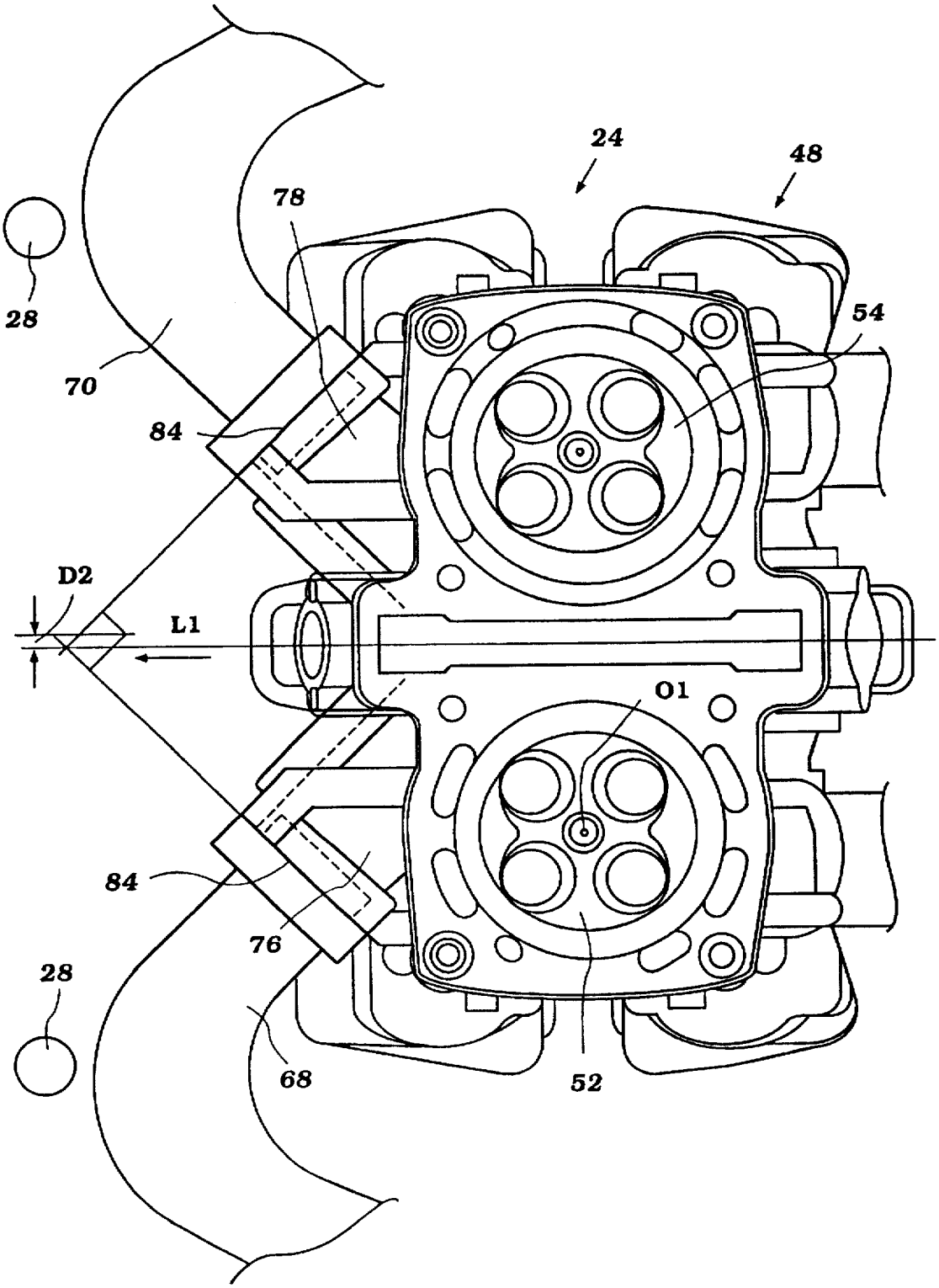
FIG. 4 is a view of the engine illustrated in FIG. 1 looking upwardly from a bottom of the cylinder head corresponding to the front cylinder bank.
Figure 5:
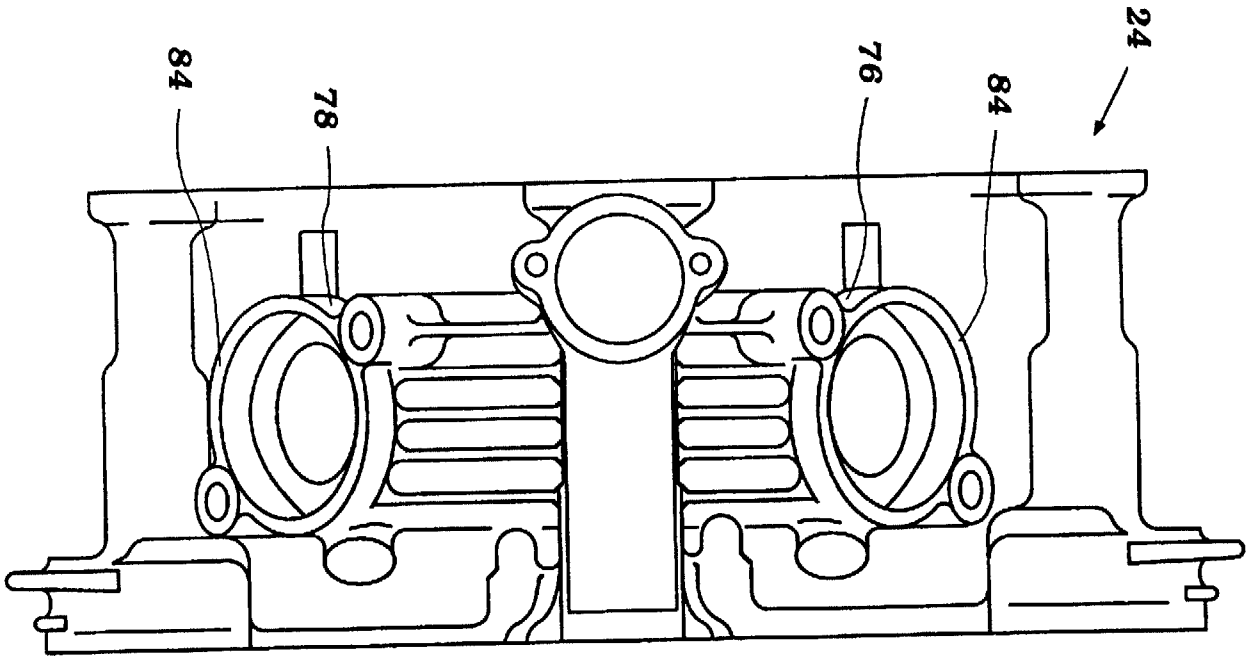
FIG. 5 is a front side view of a cylinder head of the present invention corresponding to the front bank of cylinders.
Figure 6:
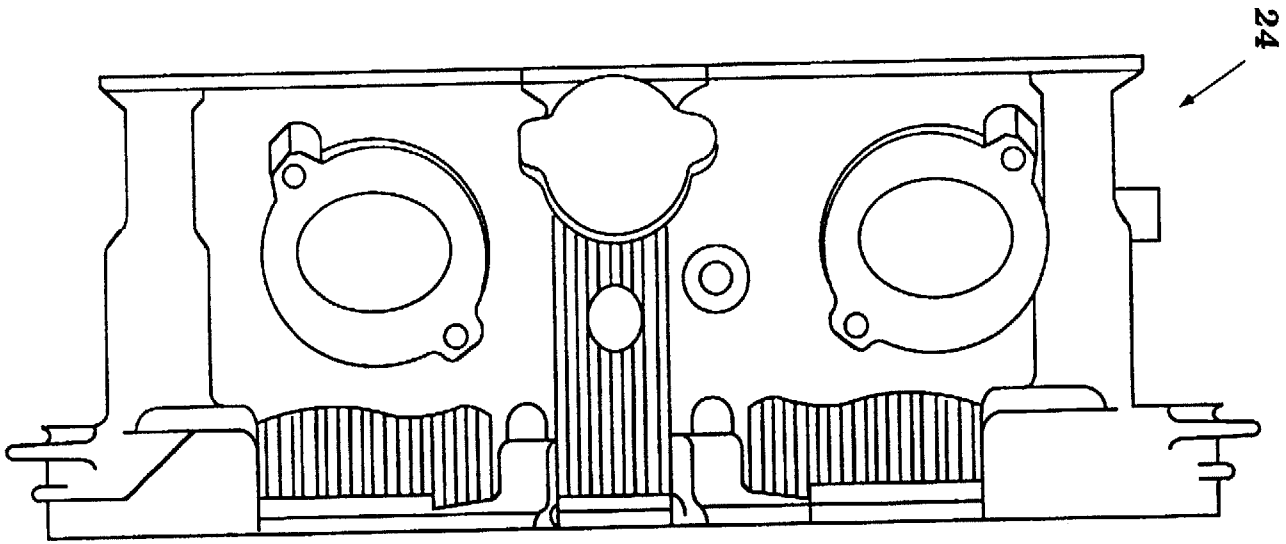
FIG. 6 illustrates the opposite side of the cylinder head of FIG. 5.

As best illustrated in FIGS. 4 and 5, the front cylinder head 24 has a surface for engaging the engine block 64. The front cylinder head 24 has a first portion for overlying the first cylinder 52 and forming a combustion chamber therewith. The front cylinder head 24 also includes a second portion for overlying the second cylinder 54 and forming a combustion chamber therewith.

In addition, the front cylinder head 24 contains a first exhaust port 76 corresponding to the first cylinder 52 and a second exhaust port 78 corresponding to the second cylinder 54. These exhaust ports 76, 78 are in communication with the pairs of exhaust passages leading from the first and second cylinders 52, 54, respectively.

The front cylinder head 24 includes a centerline L1. When the head 24 is mounted on the engine, centerline L1 lies in the vertical plane in which the front camshaft timing chain extends, and thus is also midway between the center of the first and second cylinders 52, 54.

The first and second exhaust ports 76, 78 comprise passages leading through the head from the exhaust passages containing the exhaust valves corresponding to the combustion chamber of the first and second cylinders 52, 54, respectively. The exhaust ports 76, 78 extend outwardly from the front cylinder head 24, terminating at an exterior end 84 adapted for mating engagement with the exhaust pipes 68, 70.

The first and second exhaust ports 76, 78 extend generally perpendicularly from the cylinder head 26 with respect to a line passing downwardly through the center of the first and second cylinders 52, 54. Thus, as illustrated in FIG. 1, the exhaust ports 76, 78 face generally forwardly but downwardly with respect to horizontal.

In accordance with the present invention, the ends 84 of the first and second exhaust ports 76, 78 lie in planes which are generally perpendicular to one another, as best illustrated in FIG. 4. Most preferably, the intersection of these two planes is a line which is offset from the line L1. In particular, the line of intersection formed by these planes is offset by a distance D2 from line L1, and to the right side of the motorcycle 20 when viewed facing the front of the motorcycle. The offset distance D2 is preferably equal to half of the offset distance between the timing chains.

The rear cylinder head 26 has a surface for mating engagement with the engine block 64. The rear cylinder head 26 includes a first portion corresponding to the third cylinder 56 and for forming a combustion chamber therewith. The rear cylinder head 26 also includes a second portion corresponding to the fourth cylinder 58 and for forming a combustion chamber therewith.

A centerline L2 extends through the rear cylinder head 26. When the rear cylinder head 26 is mounted on the engine 2, the centerline L2 lies within the vertical plane containing the rear camshaft timing chain, and midway between the center of the third and fourth cylinders 56, 58.

The rear cylinder head 26 includes a third exhaust port 80 corresponding to the third cylinder 56 and a fourth exhaust port 82 corresponding to the fourth cylinder 58. These exhaust ports 80, 82 are in communication with the pairs of exhaust passages leading from the combustion chambers of the third and fourth cylinders 54, 56. As with the first and second exhaust ports 76, 78, these exhaust parts include a portion which extends beyond the main body of the head 28.

The third and fourth exhaust ports 80, 82 have exterior faces 84 adapted for mating engagement with the exhaust pipes 72, 74. Each exhaust port 80, 82 extends generally perpendicularly from the cylinder head 26 from a line passing downwardly through the cylinders 56, 58. Thus, as illustrated in FIG. 1, the exhaust ports 80, 82 extend from the head 26 facing generally rearwardly, but downwardly with respect to horizontal.

Figure 7:
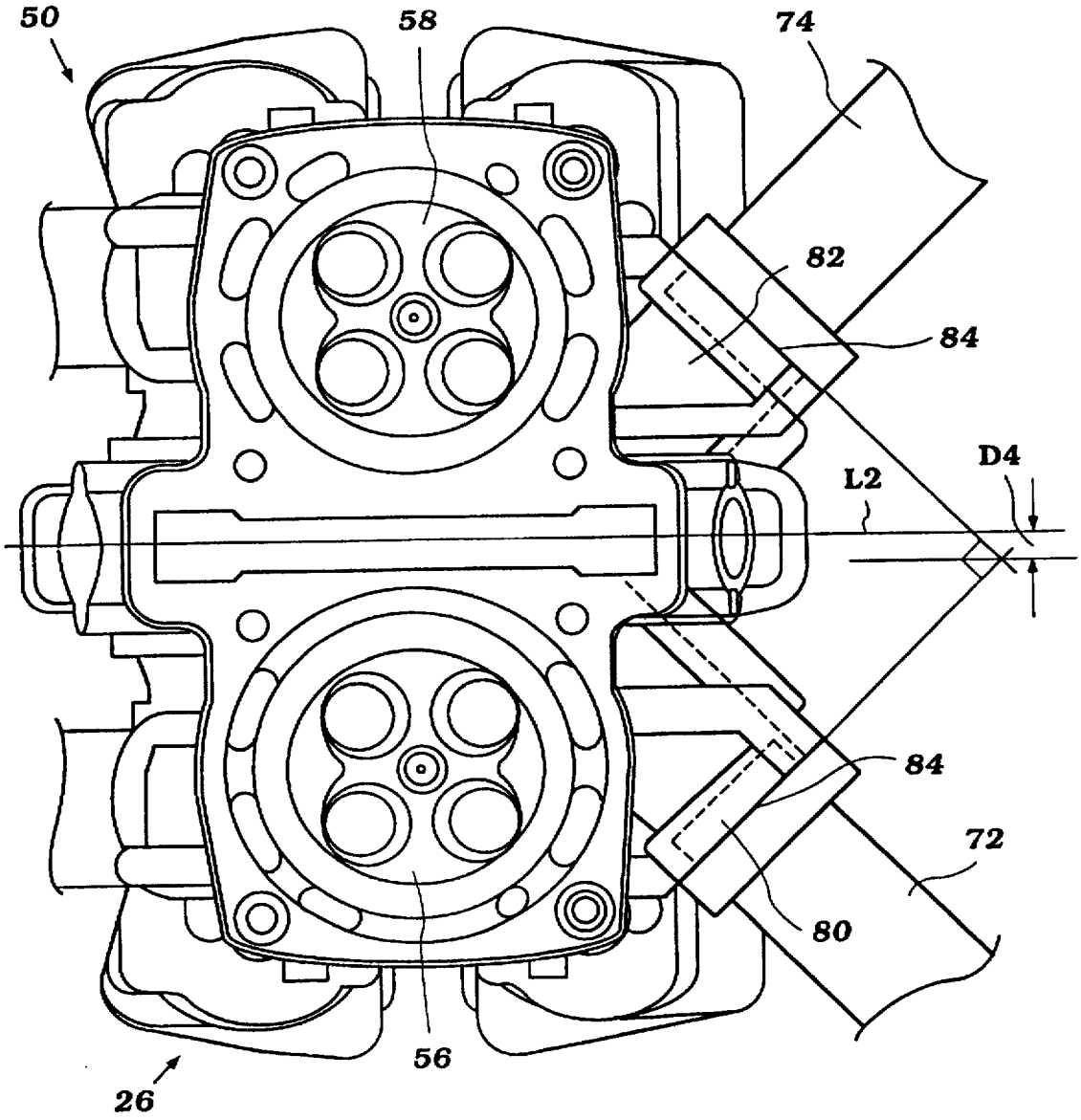
FIG. 7 is a view of the engine illustrated in FIG. 1 looking upwardly from a bottom of the cylinder head corresponding to the rear cylinder bank.

In accordance with the present invention, the terminal ends or faces 84 of these exhaust ports 80, 82 lie in planes which are perpendicular to one another, as best illustrated in FIG. 7. Most preferably, the line of intersection of these two planes is offset from the centerline line L2.

In particular, the line of intersection is offset by a distance D4 from line L2 and towards the left side of the motorcycle 20 when viewed facing the front of the motorcycle. The offset distance D4 is preferably equal to half of the offset distance between the timing chains.

Figure 3:
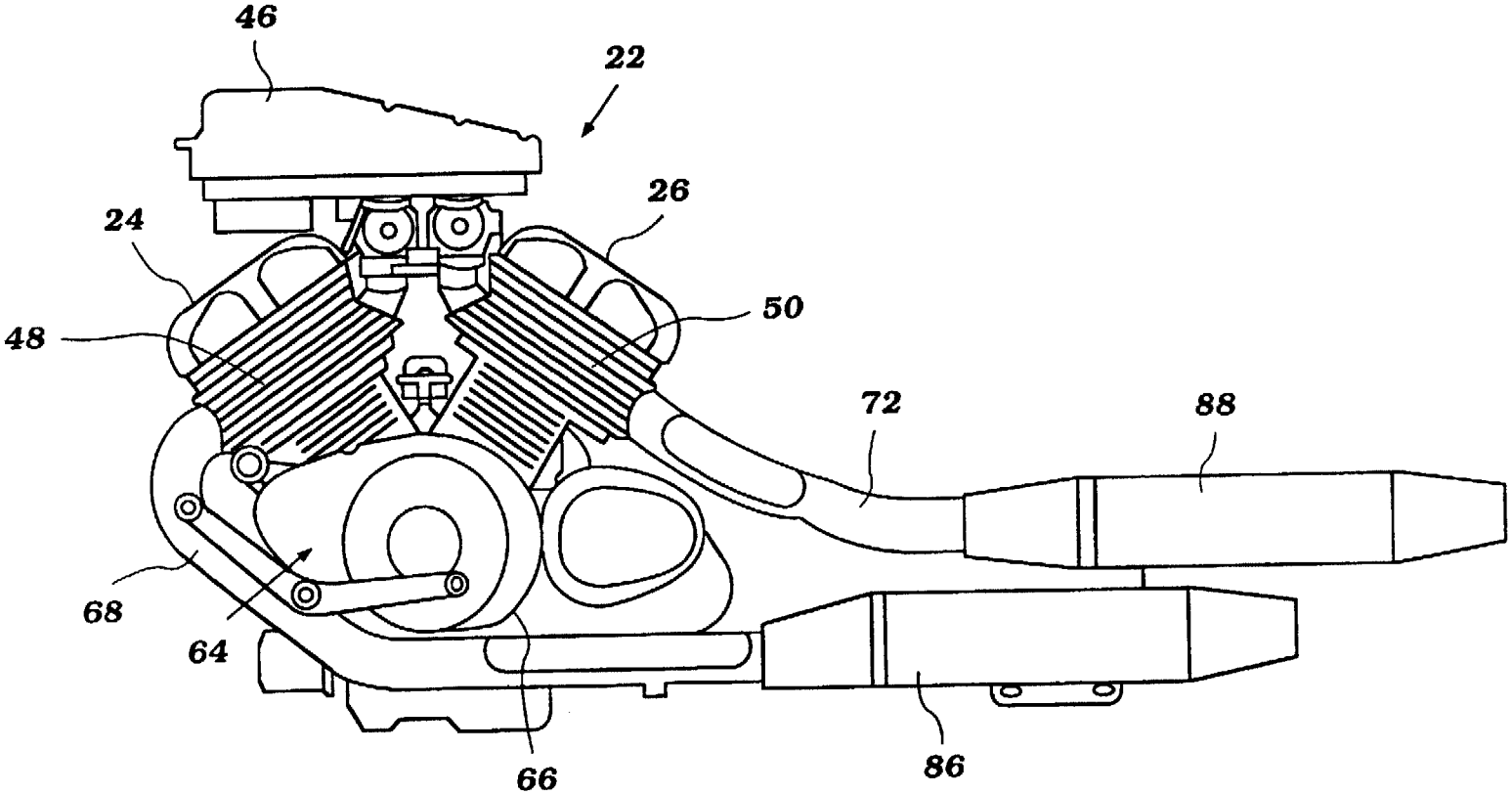
FIG. 3 is a enlarged side view of the engine of the motorcycle illustrated in FIG. 1.

The first exhaust pipe 68 is connected to the front cylinder head 24 at the first exhaust port 76. As illustrated in FIGS. 1, 3 and 4, the first exhaust pipe 68 includes a first portion which extends generally parallel to the port 76. The length of this section of the exhaust pipe 68 allows for free flow of exhaust gas into the exhaust pipe through the exhaust port 76. At the same time, the section is short enough that the exhaust pipe 68 does not extend beyond the remainder of the motorcycle, as illustrated in FIG. 2. As illustrated, the exhaust pipe 68 does not extend beyond the sides of the fuel tank 42.

The first exhaust pipe 68 then bends downwardly and inwardly towards the engine block 64, extending along the front frame section 62 of the motorcycle 20. The exhaust pipe 68 extends along the front frame section 62, without interfering with the radiator 60, to a lower, generally horizontal frame section. The exhaust pipe 68 follows the frame 28, extending along the horizontal section. The exhaust pipe 68 extends generally horizontally along the frame 28 to the rear of the motorcycle 20. A muffler 86 is mounted at the end of the exhaust pipe 68, the muffler 86 terminating adjacent the rear wheel 32.

The second exhaust pipe 70, corresponding to the second exhaust port 78 of the first cylinder head 24, has a mirror-image shape of the first exhaust pipe 68, and extends along the side of the motorcycle 20 opposite the first exhaust pipe 68.

The third exhaust pipe 72 is connected to the rear cylinder head 26 at the third exhaust port 78. A first portion of the third exhaust pipe 72 extends outwardly from the exhaust port 78 generally parallel thereto. As such, the third exhaust pipe 72 extends generally perpendicular to the rear cylinder bank 50, towards the rear of the motorcycle and somewhat downwardly.

The third exhaust pipe 72 then bends inwardly and towards horizontal. As illustrated in FIG. 1, the inward bend of the exhaust pipe 72 keeps the exhaust pipe close to the frame 28 of the motorcycle. At the same time, the bend is slight enough to prevent substantial exhaust flow retardation.

The third exhaust pipe 72 continues generally horizontally towards the rear of the motorcycle 20. A muffler 88 is positioned at the end of the third exhaust pipe 72. The muffler 88 terminates near the rear of the second wheel 32. Preferably, in order that the exhaust pipes corresponding to the front and rear cylinder banks 48, 50 be of nearly the same length, the muffler 88 terminates slightly beyond the muffler 86 corresponding to the first exhaust pipe 68.

The fourth exhaust pipe 74 is connected to the rear cylinder head 26 at the fourth exhaust port 78. The fourth exhaust pipe 74 has a mirror-image shape of the third exhaust pipe 72, and extends the opposite side of the motorcycle 20 (i.e., on the same side as the second exhaust pipe 70).

As disclosed above, the front and rear cylinder heads 24, 26 are identical to one another. The front cylinder head 24 and rear cylinder head 26 are simply mounted to their respective cylinder banks 48, 50 facing in opposite directions. This arrangement has the advantage that the production and manufacturing costs associated with the cylinder heads 24, 26 are greatly reduced.

The cylinder head and exhaust pipe arrangement of the present invention overcomes other problems of the prior art. First, the arrangement of the exhaust ports 76, 78, 80, 82 of the cylinder heads 24, 26 permits the exhaust pipes 68, 70, 72, 74 to have few bends. The bends which the exhaust pipes 68, 70, 72, 74 do contain are small radius bends. This prevents back pressure. At the same time, the exhaust pipes 68, 70, 72, 74 are routed along frame 28 of the motorcycle 20 without protruding from the sides of the motorcycle.

The exhaust system of the present invention may be utilized with engines of varying types. As one example, the exhaust system may be utilized with an engine which has a front bank containing only one cylinder and a rear bank containing only one cylinder, where each cylinder has an exhaust port corresponding to each of two exhaust valves. Exhaust pipes are connected to each exhaust port corresponding to the two exhaust valves of the single cylinder. The exhaust ports are arranged in the head corresponding to the cylinder as disclosed above.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A cylinder head for a bank of cylinders of a "V"-type internal combustion engine, the engine having a front bank and a rear bank, each bank containing at least one cylinder and having a cylinder head engaging surface, the cylinder head comprising a head member having a first surface for positioning against said cylinder head engaging surface, at least a first area for forming a combustion chamber with the at least one cylinder, a first exhaust port and a second exhaust port for exhausting gases from said bank, and a centerline extending between said first and second exhaust ports, said first exhaust port having an end positioned in a first plane and said second exhaust port having an end positioned in a second plane, the first and second planes being generally perpendicular to one another and intersecting along a line offset from said centerline.

2. The cylinder head in accordance with claim 1, wherein said first and second exhaust ports extend from said cylinder head generally perpendicular to a centerline of said cylinders.

3. The cylinder head in accordance with claim 1, wherein said engine includes a first camshaft timing chain corresponding to said front bank and a second camshaft timing chain corresponding to said rear bank, said offset equal to half of a distance separating said timing chains.

4. The cylinder head in accordance with claim 1, wherein the front bank contains two cylinders and the rear bank contains two cylinders, and wherein said first exhaust port corresponds to one of said cylinders of a bank and said second exhaust port correspond to the other cylinder of the bank.

5. In combination, an internal combustion engine having at least one cylinder bank containing at least one cylinder, a cylinder head having a portion corresponding to said at least one cylinder, a first exhaust port and a second exhaust port for exhausting gases from said bank, said first exhaust port having an end positioned in a first plane and said second exhaust port having an end positioned in a second plane, the first and second planes generally perpendicular to one another, and a first exhaust pipe extending from said first exhaust port and a second exhaust pipe extending from said second exhaust port.

6. The combination of claim 5, wherein said cylinder head has a centerline between said first and second ports, and wherein said first and second planes intersect along a line offset from said centerline.

7. The combination of claim 5, wherein said engine includes a front cylinder bank and rear cylinder bank, said front cylinder bank containing a first and a second cylinder and said rear cylinder bank containing a third and a fourth cylinder.

8. The combination of claim 7, further including a rear cylinder head, said rear cylinder head having a first portion corresponding to said third cylinder and a second portion corresponding to said fourth cylinder, a third exhaust port corresponding to said third cylinder and a fourth exhaust port corresponding to said fourth cylinder, wherein said third exhaust port has an end positioned in a first plane and said fourth exhaust port has an end positioned in a second plane, the first and second planes generally perpendicular to one another.

9. The combination of claim 8, wherein said rear cylinder head has a centerline between said first and second portions and wherein said first and second planes intersect along a line which is offset from said centerline.

10. The combination of claim 9, wherein said engine includes a first camshaft timing chain positioned in a first plane and a second camshaft timing chain positioned in a second plane, said planes separated by a distance, and wherein said offset is in an amount equal to half of said distance.

11. The combination of claim 6, wherein said engine includes a first camshaft timing chain positioned in a first plane and a second camshaft timing chain positioned in a second plane, said planes separated by a distance, and wherein said offset is in an amount equal to half of said distance.

12. The combination of claim 8, wherein a third exhaust pipe extends from said third exhaust port and a fourth exhaust pipe extends from said fourth exhaust port.

13. The combination of claim 8, wherein said third and fourth exhaust ports face opposite said first and second exhaust ports.

14. The combination of claim 8, wherein said third and fourth exhaust ports extend generally perpendicular to a centerline passing through said third and fourth cylinders.

15. The combination of claim 5, wherein said first and second exhaust pipes each have a first portion extending generally parallel to said respective first and second exhaust port.

16. The combination of claim 5, further including a motorcycle, said motorcycle having at least one front wheel and at least one rear wheel, said wheels connected to a frame, said engine having an output shaft coupled to at least one of said wheels for powering said motorcycle.

17. The combination of claim 16, wherein said first and second exhaust ports face towards the front of said motorcycle.

18. The combination of claim 16, wherein said engine has a front bank and a rear bank, said rear bank having a cylinder head including a third and a fourth exhaust port, said ports facing towards the rear of the motorcycle.

19. The combination of claim 16, wherein said engine includes a crankshaft, a first camshaft timing chain corresponding to a front bank of cylinders connected to said crankshaft, and a second camshaft timing chain corresponding to a rear bank of cylinders connected to said crankshaft, said timing chains spaced along said crankshaft a distance apart, and wherein said first and second planes intersect along a line offset from a centerline extending through said head, said offset is equal to approximately half of said distance.

20. The combination of claim 16, wherein said third exhaust port has an end positioned in a third plane and said fourth exhaust port has an end positioned in a fourth plane, said third and fourth planes extending generally perpendicular to one another.

21. The combination of claim 20, wherein said third and fourth planes intersect along a line offset from a centerline of said rear cylinder head, and wherein said engine includes a crankshaft, a first camshaft timing chain corresponding to said front bank of cylinders connected to said crankshaft, and a second camshaft timing chain corresponding to said rear bank of cylinders connected to said crankshaft, said timing chains spaced along said crankshaft a distance apart, and wherein said offset is equal to approximately half of said distance.

22. The combination of claim 16, wherein said first and second planes intersect along a line which is offset towards said first side of said motorcycle.

23. The combination of claim 21, wherein said third and fourth planes intersect along a line which is offset towards said second side of said motorcycle.

24. The combination of claim 16, wherein an exhaust pipe extends from each of said first, second, third and fourth exhaust ports.

25. The combination of claim 24, wherein said exhaust pipes do not extend beyond said first and second sides of said motorcycle.

26. The combination of claim 24, wherein said exhaust pipes terminate at said rear of said motorcycle.

27. The combination of claim 16, wherein said engine has a front bank and rear bank and each bank contains two cylinders.

* * * * *